US006352823B1

(12) United States Patent
Sato

(10) Patent No.: US 6,352,823 B1
(45) Date of Patent: Mar. 5, 2002

(54) SILVER HALIDE PHOTOGRAPHIC MATERIAL

(75) Inventor: Tadanobu Sato, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/504,120

(22) Filed: Feb. 15, 2000

(30) Foreign Application Priority Data

Jun. 16, 1999 (JP) ..... 11-170140

(51) Int. Cl.[7] ..... G03C 1/005; G03C 1/08; G03C 1/09

(52) U.S. Cl. ..... 430/605; 430/567; 430/569; 430/600

(58) Field of Search ..... 430/567, 569, 430/600, 605

(56) References Cited

U.S. PATENT DOCUMENTS

| | | | | | |
|---|---|---|---|---|---|
| 4,933,272 | A | * | 6/1990 | McDugle et al. | 430/567 |
| 5,360,712 | A | * | 11/1994 | Olm et al. | 430/567 |
| 5,457,021 | A | * | 10/1995 | Olm et al. | 430/567 |
| 5,728,517 | A | * | 3/1998 | Bryant et al. | 430/567 |
| 6,001,543 | A | * | 12/1999 | Asami et al. | 430/351 |

* cited by examiner

*Primary Examiner*—Janet Baxter
*Assistant Examiner*—Amanda Walke
(74) *Attorney, Agent, or Firm*—Sughrue Mion, PLLC

(57) ABSTRACT

The present invention provides a silver halide photographic material free of cyanide ions but having a higher photographic speed than ever. A novel silver halide photographic material is provided comprising a support having thereon at least one silver halide emulsion layer, wherein there is contained a complex in which an organic compound having no electric charge which doesn't form coordinate bond with metals or metal ions other than the central metals or metal ions occupies more than half of the central metals or metal ions as coordination site.

14 Claims, No Drawings

SILVER HALIDE PHOTOGRAPHIC MATERIAL

FIELD OF THE INVENTION

The present invention relates to a silver halide photographic material. More particularly, the present invention relates to a high speed silver halide photographic material utilizing the technique of dopants.

BACKGROUND OF THE INVENTION

As one of the techniques of modifying silver halide grains to bring about as much improvement as is expected in the properties of a silver halide photographic material as a whole, there is known a technique of incorporating a substance (dopant) other than silver and halide ions into silver halide grains. This technique is referred to as "a doping technique". In particular, many researches on the technique of doping transition metal ions have been made. As a result, it is generally recognized that the transition metal ions incorporated as a dopant into silver halide grains can effectively modify photographic properties even when the amount thereof is minute.

Besides the technique of doping transition metal ions, there is known the technique of doping silver halide grains with transition metal complexes having cyanide ions as ligands to heighten the sensitivity of silver halide emulsions. In particular, many disclosures have been made about the emulsions having sensitivities increased by doping with the hexacyano complexes containing the group VIII metals. As the dopants containing cyanide ions, for instance, a hexacyanoferrate (II) complex and a hexacyanoferrate (III) complex are disclosed in JP-B-48-35373 (The term "JP-B" as used herein means an "examined Japanese patent publication"). However, the invention cited above regards the sensitivity increasing effect as being limited to the cases of complexes containing iron ion and having no relation to the species of ligands. Many other cases are known where high sensitivity can be conferred on emulsions by doping them with hexacyanoferrate (II) complexes. Such cases are disclosed, e.g., in JP-A-5-66511 (The term "JP-A" as used herein means an "unexamined published Japanese patent application") and U.S. Pat. No. 5,132,203. There are also known the emulsions which are doped with cyano-complexes of metals other than iron to obtain high sensitivity. For instance, JP-A-2-20853 discloses that silver halide emulsions can acquire high sensitivity by comprising silver iodochloride doped with a rhenium, ruthenium, osmium or iridium complex. Many of other metal complexes are also used as dopant, and can produce not only the sensitivity increasing effect but also various effects, such as an improvement in reciprocity failure and an increase in contrast. For instance, U.S. Pat. No. 2,448,060 discloses the emulsions sensitized by doping them with a platinum (II) or palladium (IV) complex having halogen ions as ligands. And U.S. Pat. No. 3,790,390 discloses the emulsions doped with cyano-cobalt (III) complexes in addition to the emulsions doped with cyano-iron (II) or cyano-iron (III) complexes, wherein spectral sensitizing dyes are also contained. Further, the silver halide grains formed in the presence of a rhodium (III) complex containing 3, 4, 5 or 6 cyanide ions as ligands are disclosed in U.S. Pat. No. 4,847,191. Those patent prove that the high intensity failure can be diminished by dopants. In European Patents 0335425 and 0336426 and JP-A-2-20854 are disclosed the silver halide emulsions doped with rhenium, ruthenium, osmium or iridium complexes having at least 4 cyano-ligands. Therein, it is described that the doped emulsions are improved in storage stabilities of sensitivity and gradation and reduced in low intensity failure. European Patent 0336427 and JP-A-2-20852 disclose the silver halide emulsions respectively using vanadium, chromium, manganese, iron, ruthenium, osmium, rhenium and iridium complexes having the octahedrasl structure with nitrosyl or thionitrosyl ligands, wherein the low intensity reciprocity failure is improved without attended by lowering of medium illumination sensitivity. As the dopants other than transition metal ions, the emulsions doped with bismuth or lead ions are disclosed in U.S. Pat. No. 3,690,888, and the emulsions containing the group XIII or XIV metal ions are disclosed in JP-A-7-128778.

With respect to the ligands of complexes used as dopant, the cyanide ions are regarded as most popular, but halide ions are also used frequently. As examples of a dopant having the structure of $[MCl_6]^{n-}$ wherein M is a metal, mention may be made of the hexachlororuthenium, hexachloroiridium and hexachlororhenium complexes disclosed, e.g., in JP-A-63-184740, JP-A-1-285941, JP-A-2-20852 and JP-A-2-20855. Further the octahedral rhenium complexes having halogeno, nitrosyl, thionitrosyl, cyano, aquo or/and thiocyano ligands are disclosed as dopants in European Patent 0336689 and JP-A-2-20855. In addition, the emulsion containing a octahedral transition metal complex having one carbonyl ligand and the emulsion containing a octahedral transition metal complex having two oxo ligands are disclosed as those having useful photographic properties in JP-A-3-118535 and JP-A-3-118536, respectively.

In recent years, techniques involving the doping of silver halide grains with complexes having an organic compound as a ligand for the purpose of modifying the properties of emulsion have been studied. U.S. Pat. Nos. 5,360,712, 5,457,021 and 5,462,849, European Patent (EP) 0709724, JP-A-7-72569 and JP-A-8-179452 disclose examples of the use of many complexes comprising organic compounds as ligands. It is described that emulsions comprising silver halide grains doped with $[(NC)_5Fe(\mu\text{-}4,4'\text{-bipyridine})Fe(CN)_5]^{6-}$ in particular have a remarkably raised sensitivity. JP-A-11-24194 discloses that emulsions having a high sensitivity and improved reciprocity failure is obtained by doping with $[Fe(CO)_4(P(Ph)_3)]^0$ or $[Fe(CO)_3(P(Ph)_2)]^0$. Further, JP-A-11-102042 discloses that $[M(CN)_5L]^{\cdot-}$ (wherein M represents $Fe^{2+}$, $Ru^{2+}$ or $Ir^{\cdot+}$), $[Fe(CO)_4L]^0$, $[M'(CN)_3L]-$ (wherein M' represents $PD^{2+}$ or $Pt^{2+}$) and $[IrCl_5L]^{2-}$ type complexes wherein L is 2-mercaptobenzimidazole, 5, methyl-s-triazolo(1.5-A)pyrimidine-7-ol or 2-mercapto-1,3,4-oxadiazole can provide high speed emulsions. Moreover, JP-A-10-293377 discloses that emulsions doped with $[RuCl_5L']^{2-}$ (wherein L' represents imidazole, benzimidazole or derivative thereof) provide an extremely increased contrast at which the resulting sensitivity is far higher than that of emulsions doped with the conventional desensitized high contrast dopants.

When the octahedral complexes coordinated with six ligands are incorporated as dopants into silver halide grains, as described in references, including J. Phys.: *Condens. Matter*, 9 (1997) 3227–3240, literatures and patents, the $[AgX_6]^{5-}$ unit (X=halogen ion) in silver halide grains is replaced by the complex molecules so that the central metal (ion) occupies the lattice position of $Ag^+$ ion and the ligands occupy the lattice position of halide ions. Accordingly, U.S. Pat. No. 5,360,712 discloses that the complex to be used as a dopant must be occupied in the coordination site of central metal (ion) by halogen or pseudo-halogen ions in a proportion of half or more and the organic compound which can be used as a ligand must have a proper molecular size with respect to the size of the space in the crystal lattice as a host.

On the other hand, U.S. Pat. No. 3,672,901, JP-A-2-259749 and JP-A-336537 disclose examples of the use of, as a dopant, a complex comprising no halogen or pseudo-halogen ions bonded thereto at the coordination sites of metal ion such as $[Fe(ETDA)]^{2-}$ (wherein EDTA represents ethylenediamine tetraacetic acid) and $[Ir(C_2O_4)_3]^{3-}$. The above described U.S. Pat. No. 5,360,712 discloses that these dopants have no large effect. According to this patent, these complexes have all coordination sites occupied by an organic compound and thus cannot have halogen or pseudo-halogen ions required to take themselves into silver halide grains and are not appropriate as dopant.

As described above, complexes having an organic compound as ligand which have heretofore been used as dopant each have as ligand an organic compound occupying only one or two of the six coordination sites of central metal (ion). There have been known no examples of the use of complexes each having greater than half or all of the coordination sites occupied by an organic compound, particularly dopants containing ligands having no electric charge and having no sites interact with other metal ions on the surface of complex molecules, and the resulting modification of photographic properties.

In order that the emulsions acquire high speed, they are required to undergo chemical sensitization besides the addition of dopants. In the case where the emulsion doped with a cyano-complex is subjected to gold sensitization as typical of chemical sensitization, as described, e.g., in JP-A-8-62761, the cyanide ions liberated from the complex are adsorbed to the silver halide grain surface and form a cyano-gold complex together with the gold ion added as a gold sensitizer, thereby inhibiting the formation of sensitized center by the gold sensitizer. In order to effect gold sensitization of the emulsion containing a cyano-complex as dopant, it is required to keep the cyano groups away from the silver halide grain surface, e.g., by making the cyano-complex dope the sub-surface of silver halide grains as described in U.S. Pat. No. 5,132,203 and European Patent 0508910. As another preventive against the inhibition of gold sensitization, there is known the method of adding zinc ion or the like as disclosed in JP-A-6-308653. As mentioned above, a further measure must be taken in order to achieve both the increase of photographic speed by the dopant which has heretofore relied on cyano complex and the gold sensitization.

Most of the dopants hitherto known to enable the increase of photographic speed are complexes having cyanide ions as ligands. These cyano-complexes still have a toxicity problem common to cyan compounds even if their problem of inhibiting gold sensitization can be overcome. Therefore, new dopants containing no cyanide ions and capable of imparting high speed to emulsions have been awaited.

SUMMARY OF THE INVENTION

An object of the present invention is to provide a silver halide photographic material containing no cyanide ions but having a higher photographic speed than ever.

The foregoing object of the present invention will become apparent from the following detailed description and examples.

The foregoing object of the present invention is attained by a silver halide photographic material according to any of the following item (1) and the following items (2) to (12) which are preferred embodiments:

(1) A silver halide photographic material comprising a support having thereon at least one silver halide emulsion layer, wherein there is contained a complex in which an organic compound having no electric charge which doesn't coordinate with a metal or a metal ion other than the central metals or metal ions occupies more than half of the central metals or metal ions as coordination site.

(2) The silver halide photographic material according to the foregoing item (1), wherein the silver halide grains contained in the emulsion contain a complex in which an organic compound having no electric charge which doesn't coordinate with a metal or a metal ion other than the central metals or metal ions occupies more than half of the central metals or metal ions as coordination site.

(3) The silver halide photographic material according to the foregoing item (1) or (2), wherein the silver halide grains contained in the silver halide emulsion contain a metal complex represented by the following formula I or II:

$$[ML_nX_{(6-2n)}]^{M+} \quad \text{(I)}$$

$$[ML_{[(6-3iX1/3)]}L'_iX_{[(6-3iX1/3)]}]^{i+} \quad \text{(II)}$$

wherein M represents an arbitrary metal or metal ion; L represents an organic bidentate ligant coordinated to a metal or a metal ion (i.e., an organic compound which is coordinated to a metal or a metal ion at two donor sites of the ligand; L' represents an organic tridentate ligant coordinated to a metal or a metal ion (i.e., an organic compound which is coordinated to a metal or a metal ion at three donor sites of the ligand); X represents an arbitrary chemical species, with the proviso that a plurality of L's, (L')'s and X's, if contained in the same compound, may be the same or different compounds, respectively; n represents an integer of 2 or 3; i represents an integer of 1 or 2; and m and j each represent an integer of from −4 to +5.

(4) The silver halide photographic material according to the foregoing item (3), wherein L in the formula I or II comprises 2,2'-bipyridine or 1,10-phenanthroline as a basic structure.

(5) The silver halide photographic material according to the foregoing item (3), wherein L' in the formula II comprises 2,2':6'−2"-terpyridine as a basic structure.

(6) The silver halide photographic material according to the foregoing item (1) or (2), wherein the silver halide grains contained in the emulsion contain a metal complex represented by the following formula III:

$$[ML''_kX_{(6-k)}]^{1+} \quad \text{(III)}$$

wherein M represents an arbitrary metal or metal ion; L" represents an organic compound which is a monodentate ligand coordinated to a metal or a metal ion; X represents an arbitrary chemical species, with the proviso that a plurality of (L")'s and X's, if contained in the same compound, may be the same or different compounds, respectively; k represents an integer of 4 to 6; and 1 represents an integer of −4 to +5.

(7) The silver halide photographic material according to the foregoing item (6), wherein L" in the formula III comprises a basic structure selected from the group consisting of furan ring, thiophenine ring, 2H-pyrrole ring, pyran ring and pyridine ring as a basic structure.

(8) The silver halide photographic material according to any one of the foregoing items (4) to (6), wherein M in the formulae I, II and III is a metal ion selected from the group consisting of magnesium ion, calcium ion, strontium ion, barium ion, iron ion, ruthenium ion, manganese ion, cobalt ion, rhodium ion, iridium ion, copper ion, nickel ion, palladium ion, platinum ion, gold ion, zinc ion, titanium ion, chromium ion, osmium ion, cadmium ion and mercury ion.

(9) The silver halide photographic material according to any one of the foregoing items (4) to (6), wherein M in the formulae I, II and III is a metal ion selected from the group consisting of iron ion, ruthenium ion, manganese ion, cobalt ion, rhodium ion, iridium ion, titanium ion, chromium ion, and osmium ion.

(10) The silver halide photographic material according to the foregoing item (9), wherein in the formulae I, M represents a metal ion selected from the group consisting of iron ion, ruthenium ion and cobalt ion, L represents 2,2-bipyridine or 1,10-phenanthroline, n represents an integer of 2 or 3 and m represents an integer of 2.

(11) The silver halide photographic material according to the foregoing item (9), wherein in the formulae II, M represents iron ion or ruthenium ion, L represents 2,2-bipyridine or 1,10-phenanthroline, L' represents 2,2':6'-2"-terpyridine, i represents an integer of 1 or 2 and j represents an integer of 2.

(12) The silver halide photographic material according to the foregoing item (9), wherein in the formulae III, M represents iron ion or ruthenium ion, L" represents pyridine, k represents an integer of 6 and l represents an integer of 2.

DETAILED DESCRIPTION OF THE INVENTION

As described, e.g., in *Bulgarian Chem. Commun.*, 20 (1993) 350–368, *Radiat. Eff. Defects Solids*, 135 (1955) 101–104, and *J. Phys.: Condens Matters*, 9 (1977) 3227–3240, the hexacyano-complexes added for doping silver halide grains introduce shallow electron centers arising from the coulombic traps into the silver halide grains. In particular, when the complex contains a divalent metal ion, such as $Fe^{2+}$ and $Ru^{2+}$, as its central metal (ion), electron traps having an optimum depth arising from the coulombic field can be introduced into an atmosphere of grains formed by $Ag^+$ and $Cl^-$ by an excess charge of +1 to elongate the time from the generation of photoelectrons by exposure to the deactivation thereof, thereby considerably increasing the photographic speed, as disclosed in *ICPS,* 1998, *Final program and Proceedings*, Vol. 1, p. 89, *ICPS,* 1998, *Final program and Proceedings*, Vol. 1, p. 92, and JP-A-8-286306. Therein, the cyanide ions which have been used as ligand become ligands essential to producing a strong ligand-field effect. In other words, electron is donated from metal to ligand (back-donation effect) to form π-bond that brings about further stabilization of $t_{2g}$ orbital, reduction of the bond distance between metal and ligand and increase of effective positive charge of metal ions resulting in an effect of drastically increasing the split of d orbital of metal. This effect causes the $e_g$ orbital in the complex (lowest unoccupied molecular orbital in the complex) with which the silver halide grains have been doped to have a higher energy than that of the bottom of the conduction band of silver halide, which has nothing to do with electron trapping. Only in this manner, shallow electron centers arising from the coulombic field can be formed in the vicinity of dopants.

It is generally known that heterocyclic compounds, particularly 1,10-phenanthroline or 2,2'-bipyridine, bring about a strong ligand-field effect close to cyano-complexes during complexing. It can be thought that by doping with these complexes the lowest unoccupied molecular orbital can be at a higher energy level than that of the bottom of the conduction band of silver halide similar to the hexacyano-complexes. Further, the use of a compound having no electric charge as ligand causes excess charge taking part in electron capture by coulombic center to be distributed not only on a metal but also on ligands. Taking into account the formation of silver nuclei in silver halide grains, it is thought that when photo-excited electrons move more freely in a wide range, silver nuclei can be formed efficiently, as in impurity band in semiconductors, In actuality, according to ENDOR's experiment on an emulsion doped with hexacyanoferrate (II) described in *J. Phys.: Condens Matters*, 9 (1977) 3227–3240, the range of dopant concentration at which an electron signal regarded to be trapped by impurity band begins to be observed coincides with the range of dopant concentration at which a sensitivity increase clearly begins. The state of shallowly trapped electrons can be described by effective mass approximation and thus can be considered with hydrogenlike 1s model. It can thus be presumed that the greater the radius of the field by which these electrons are bound (radius of hydrogen atom model described by effective mass approximation) is, the greater is the resulting sensitivity rise. From this standpoint of view, the foregoing heterocyclic compounds are preferably used as ligand. On the other hand, it can be thought that in order to obtain proper shallow electron traps by dopants, the molecule used as dopant preferably has less electron distribution so that electrons cannot be localized in the electron traps. If there are other donor sites of hetero atoms or substituents besides donor sites to central metal inside the ligand, it is very likely that polarization can occur in the ligand. It is thus likely that these structures are not suitable for trapping of electrons by a uniformly mild constraint force. From this standpoint of view, as the dopant for providing high sensitivity there may be used an organic compound, particularly a complex having an aromatic compound or heterocyclic compound as ligand. In particular, taking into account the ligand-field effect, compounds which are coordinated to metal ions at two donor sites or three donor sites are desirable.

The term "organic compound " as used herein means a compound having a chain or cyclic hydrocarbon as a parent structure or a compound in which carbon or hydrogen atoms of a part of the parent structure are replaced by other atoms or atomic groups. Taking into account the magnitude of ligand-field effect as mentioned above, the organic compound is preferably an aromatic compound or heterocyclic compound. As such an aromatic compound there is preferably used a compound having a substituent which forms a coordination site on two adjacent carbon atoms. Examples of such an aromatic compound include verathol, catechol, (+/−)-hydrobenzoin, 1,2-benzenedithiol, 2-aminophenol, o-anisidine, 1,2-phenylenediamine, 2-nitronaphthol, 2-nitroaniline, and 1,2-dinitrobenzene. Further, an aromatic compound which doesn't have a substituent which forms a coordination site on two adjacent carbon atoms but has two coordination site-forming substituents which are located at a distance such that they can be coordinated to one metal. Specific examples of such an aromatic compound include benzyl, 1,8-dinitronaphthalene, and 1,8-naphthalenediol. These aromatic compounds are preferred examples of bidentate ligand L in the formula I. The heterocyclic compound coordinated at one-donor site preferably has an oxygen atom, sulfur atom, selenium atom, tellurium atom or nitrogen atom as hetero atom in its ligand. Also preferably, the heterocyclic compound has a phosphorus atom. The heterocyclic compound which is coordinated at two donor sites or three donor sites to metal or metal ion is preferably a ring-condensed heterocyclic compound in which these heterocyclic compounds coordinated at one-donor site are connected to each other. Specific examples of monodentate ligand L" in the formula III include furan, thiophenine, 2H-pyrrole, pyran, pyridine, and derivative thereof. The preferred bidentate ligand L in formula I is a compound in which the compound preferred as L" is connected, such as 2,2'-bithiophene, 2,2'-bipyridine and derivatives thereof. Further, a compound having a condensed ring connected to the basic structure of these bidentate ligands, such as 2,2'-biquinoline, 1,10-phenanthroline and derivative thereof is preferably used as bidentate ligand L in formula I. Specific preferred examples of L' in the formula II include 2,2':5',2"-terthiophene, 2,2':5',2"-terpyridine, and derivative thereof. As the substituent on these derivatives there may be preferably used one which doesn't interact with metal ions. Even if these derivatives have a substituent which can be coordinated to metal, compounds which have a substituent having a donor atom coordinated to the central metal and thus form bi- or tri-dentate ligands as a whole, are preferably used. Specific preferred examples of these substituents include a hydrogen atom, substituted or unsubstituted alkyl groups (e.g., methyl, ethyl, n-propyl, isopropyl, n-butyl, t-butyl, hexyl, octyl, 2-ethylhexyl, dodecyl, hexadecyl, t-octyl, isodecyl, isostearyl, dodecyloxypropyl, trifluoromethyl), alkenyl groups, alkinyl groups, aralkyl groups, cycloalkyl groups (e.g., cyclohexyl, 4-t-butylcyclohexyl), substituted or unsubstituted aryl groups (e.g., phenyl, p-tolyl, p-anisyl, p-chlorophenyl-4-t-butylphenyl, 2,4-di-t-aminophenyl), halogen (e.g., fluorine, chlorine, bromine, iodine), cyano groups, mercapto groups, hydroxyl groups, alkoxy groups (e.g., methoxy, butoxy, methoxyethoxy, dodecyloxy, 2-ethylhexyloxy), aryloxy groups (e.g., phenoxy, p-tolyloxy, 4-t-butylphenoxy, alkylthio, arylthio, acyloxy, sulfonyloxy), substituted or unsubstituted amino groups (e.g., amino, methylamino, dimethylamino, anilino, N-methylanilino), and acyl groups (e.g., formyl, acetyl). The adjacent substituents in these molecules may be subjected to ring closure to form a saturated carbon ring, aromatic carbon ring or heteroaromatic ring. In the present invention, however, the ligand in the complex formed by these basic structure and substituents is limited to an organic compound which neither has electric charge nor interacts with metals or metal ions other than the central metal or metal ion even during complexing.

The central metal of the invention is not specifically limited. In practice, however, supposing that as described in many reference, including J. Phys.: *Condens. Matter*, 9 (1997) 3227–3240, and many patents, when the octahedral complexes (six-coordinated) are incorporated as dopants into silver halide grains, the $[AgX_6]^{5-}$ (X−=halogen ion) in silver halide grains functions as a unit to enable partial replacement of the grains by the dopants, the metals capable of assuming either four-coordinated or six-coordinated structure around them are preferably used. It is more desirable that those metals or the ions thereof have no unpaired electron or, when the d-orbital of those metals are split by the ligand field, all the stabilized orbital thereof are filled with electrons. Specific preferred examples of such a central metal (ion) include alkaline earth metal ion, iron ion, ruthenium ion, manganese ion, cobalt ion, rhodium ion, iridium ion, copper ion, nickel ion, palladium ion, platinum ion, gold ion, zinc ion, titanium ion, chromium ion, osmium ion, cadmium ion, and mercury ion. Particularly preferred among these metal ions are iron ion, ruthenium ion, manganese ion, cobalt ion, rhodium ion, iridium ion, titanium ion, chromium ion, and osmium ion. Most preferably, iron ion, ruthenium ion, and cobalt ion are used.

Specific examples of the complexes according to the invention will be given below, but the present invention should not be construed as being limited thereto.

$[M(bpy)_3]^{2+}$
M = $Fe^{2+}$, $Ru^{2+}$, $Co^{2+}$
bpy = 2,2'-bipyridine
$[M(py)_6]^{2+}$
M = $Fe^{2+}$, $Ru^{2+}$, $Co^{2+}$
py = pyridine
$[M(bpy)_2L_2]^{n+}$
M = $Fe^{2+}$, $Ru^{2+}$, $Co^{2+}$
bpy = 2,2'-bipyridine
n = 2, 1, 0

L = $Cl^-$, $CN^-$, $NH_3$, $H_2O$, CO, $H_2$, $CH_3CN$, 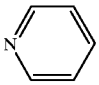

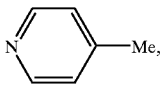

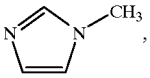

,

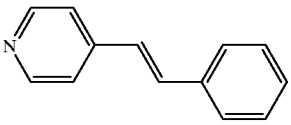

methyl-diphenyl-phosphine, butylamine
$[M(bpy)_2LL']^{n+}$
M = $Fe^{2+}$, $Ru^{2+}$, $Co^{2+}$
bpy = 2,2'-bipyridine
n = 2, 1, 0

$[M(phen)_3]^{2+}$
M = $Fe^{2+}$, $Ru^{2+}$, $Co^{2+}$
phen = 1,10-phenanthroline
$[M(trpy)_2]^{2+}$
M = $Fe^{2+}$, $Ru^{2+}$, $Co^{2+}$
trpy = 2,2':5',2-terpyridine -continued
L, L′ = $Cl^-$, 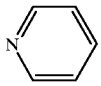
CN, 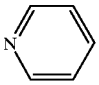
$CH_3CN$, $Cl^-$
CO, $Cl^-$
$H_2$, $Cl^-$
$[M(bpy)_2L]^{2+}$
M = $Fe^{2+}$, $Ru^{2+}$, $Co^{2+}$
bpy = 2,2′-bipyridine
L = 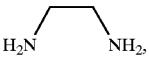 , 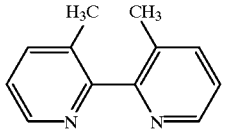 , 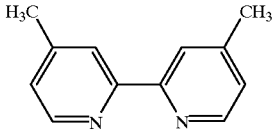
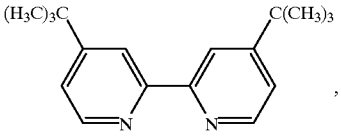 , 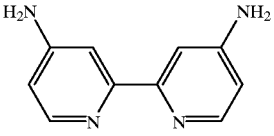
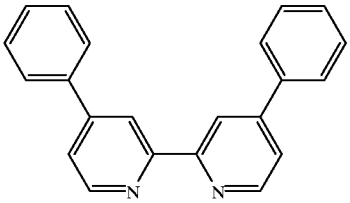 , 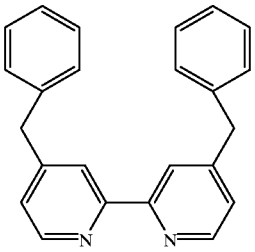 , 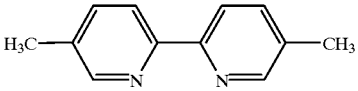
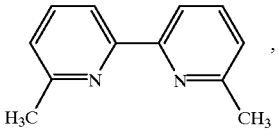 , 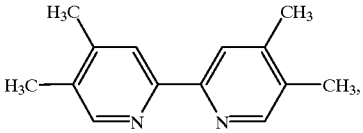 , 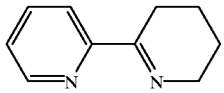
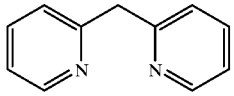 , 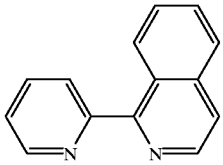 , 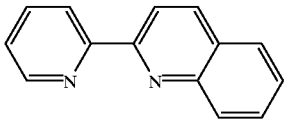
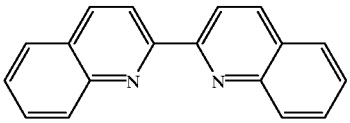 , 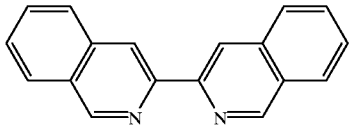 , 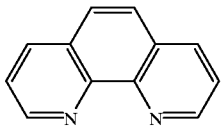
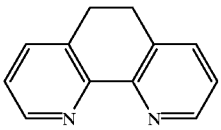 , 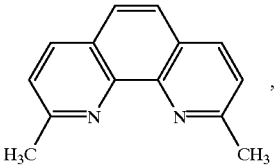 , 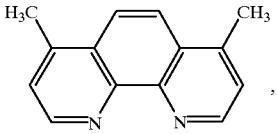 , 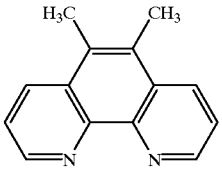

-continued

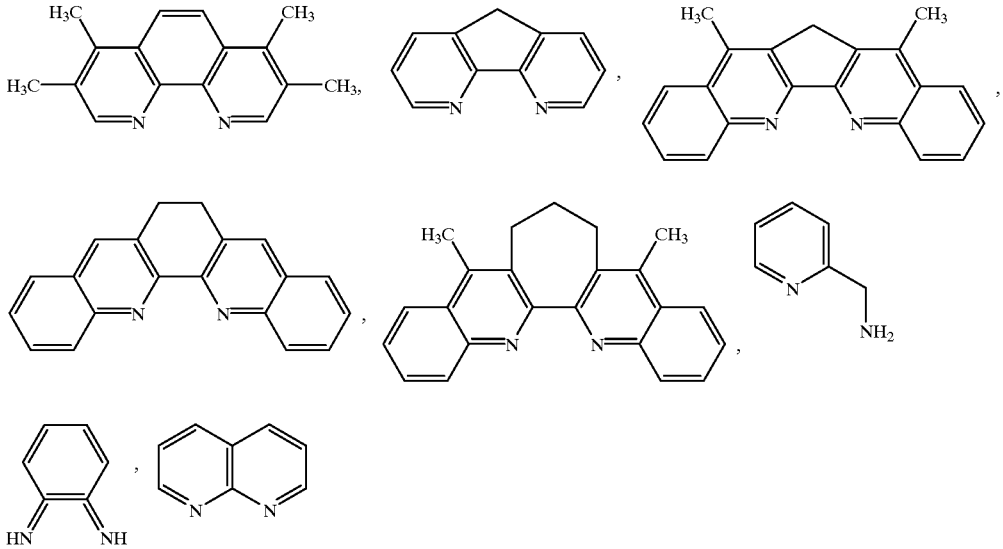

$[ML_2]^{2+}$
M = $Fe^{2+}$, $Ru^{2+}$, $Co^{2+}$

L =

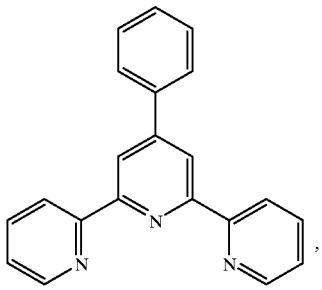

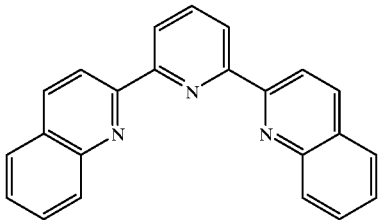

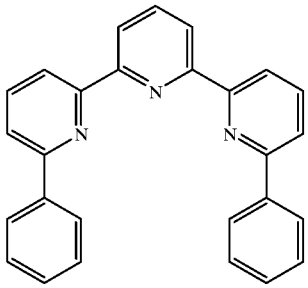

$[M(bpy)(phen)_2]^{2+}$
M = $Fe^{2+}$, $Ru^{2+}$, $Co^{2+}$
bpy = 2,2'-bipyridine
phen = 1,10-phenanthroline $[M(bpy)(py)(en)]^{2+}$
M = $Fe^{2+}$, $Ru^{2+}$, $Co^{2+}$
bpy = 2,2'-bipyridine
py = pyridine
en = ethylenediamine $[M(bpy)(trpy)L]^{2+}$
M = $Fe^{2+}$, $Ru^{2+}$, $Co^{2+}$
bpy = 2,2'-bipyridine
trpy = 2,2':5',2"-terpyridine
L = $Cl^-$, $CN^-$, $NH_3$ $[M(bpy)(phen)(py)]^{2-}$
M = $Fe^{2+}$, $Ru^{2+}$, $Co^{2+}$
bpy = 2,2'-bipyridine
phen = 1,10-phenanthroline
py = pyridine $[M(bpy)(py)(NH_3)]^{2+}$
M = $Fe^{2+}$, $Ru^{2+}$, $Co^{2+}$
bpy = 2,2'-bipyridine
py = pyridine In the present invention, the doping complex molecule is a cation. As the anion with which the cation forms a salt there may be preferably used one which can be easily dissolved in water to facilitate the precipitation of silver halide emulsion. Specific preferred examples of such an anion include halogen ion, nitric acid ion, perchloric acid ion, tetrafluoroboric acid ion, hexafluorophosphoric acid ion, tetraphenylboric acid ion, hexafluorosilicic acid ion, and trifluoromethanesulfonic acid ion. However, anions having strong coordination properties such as cyano ion, thiocyano ion, nitrous acid ion and oxalic acid ion undergo exchange reaction with the ligands in the complex of the present invention and thus are probably not able to maintain the composition and structure of the complex of the present invention. Accordingly, these anions are not desirable.

The synthesis of the complexes of the present invention can be accomplished by some methods. Referring to [Ru (py)6]2+ (in which py represents pyridine) for example, a synthesis method is described in *J. M. Chem. Soc.*, 101 (1979) 4906–4917. Referring to ruthenium complexes, *Coord. Chem. Rev.*, 84 (1988) 85–277 is a well-compiled introduction. Many complexes can be synthesized on the basis of these references.

It is desirable that each of the complexes be incorporated into silver halide grains by direct addition to a reaction solution at the step of forming silver halide grains, or by addition to a solution for grain-forming reaction via the addition to an aqueous halide solution or another solution for forming silver halide grains. Also, the combination of these methods may be adopted for doping silver halide grains.

In order to dope the silver halide grains with the complexes of the present invention, the complexes may be uniformly distributed inside the grains. Alternatively, as disclosed in JP-A-4-208936, JP-A-2-125245 and JP-A-3-188437, the complexes may be localized to have a higher concentration in the grain surface layer. Further alternatively, the silver halide grains may be doped with the complexes only thereinside but provided with an undoped layer on the surface thereof. In the present invention, the silver halide grains are preferably doped with the complexes in the surface layer thereof. In another way as disclosed in U.S. Pat. Nos. 5,252,451 and 5,256,530, the grain surface phase may be modified by physically ripening with doped fine grains. In still another way, fine grains doped with a complex are prepared, they are added to an emulsion and the resulting emulsion is subjected to physical ripening, thereby doping the silver halide grains with the complex. The aforementioned ways may be adopted in combination.

The suitable amount of each of the complexes used as dopant of the present invention is from $1\times10^{-9}$ to $1\times10^{-2}$ mols, preferably from $1\times10^{-7}$ to $1\times10^{-3}$ mols, per mol of silver halide.

The silver halide emulsion used in the present silver halide photographic material have no particular restriction as to the silver halide, but any of silver chloride, silver chlorobromide, silver bromide, silver iodochloride and silver iodobromide can be used therein. Emulsions containing bromide or iodide ions are preferred to the pure silver chloride emulsions. The silver halide grains have no particular limitation on size, but it is desirable for their size to be from 0.01 to 3 $\mu$m in terms of equivalent sphere diameter. The silver halide grains may have either a regular crystal form (normal crystal grain) or an irregular crystal form, but the normal crystal grains having the regular crystal form are preferred. Examples of the regular crystal form include the crystal forms of a cube, an octahedron, a dodecahedron, a tetradecahedron, an eicosanhedron and an octatetracontahedron. Examples of the irregular crystal form include a spherical crystal form and a pebble-like crystal form. As the silver halide grains be doped with the complexes of the present invention there may be used those having a crystal form wherein two or more twin planes are present. Tabular angular or triangular grains each having two or three parallel twin planes are desirable. Further, it is preferred that the tabular grains are monodisperse grains in a grain size distribution. The preparation of monodisperse tabular grains is disclosed in JP-A-63-11928. The description of monodisperse tabular hexagonal grains is found in JP-A-63-151618. The monodisperse tabular circular grain emulsion is described in JP-A-1-131541. Further, JP-A-2-838 discloses the emulsion wherein at least 95%, based on projected area, of the total grains are tabular grains having two twin planes parallel to the major plane and the size distribution of these tabular grains is monodisperse. EP-A-0514742 discloses the tabular grain emulsion prepared in the presence of a polyalkylene oxide block polymer and thereby achieving a variation coefficient of 10% or below with respect to the grain size distribution. By using these techniques, desirable monodisperse grains of the present invention can be prepared.

There are known the tabular grains whose major planes are (100) faces and the tabular grains whose major planes are (111) faces. The silver bromide of the former type are disclosed in U.S. Pat. No. 4,063,951 and JP-A-5-281640, while the silver chloride of the former type are disclosed in EP-A-0534395 and U.S. Pat. No. 5,264,337. The tabular grains of the latter type can have various shapes wherein at least one twin plane is present, and those of silver chloride are described in U.S. Pat. Nos. 4,399,215, 4,983,508 and 5,183,732, JP-A-3-137632 and JP-A-3-116113. The dopants of the present invention can be preferably applied also to tabular grains whose major planes are (100 faces and the tabular grains whose major planes are (111) faces.

The silver halide grains may have dislocation lines on the inside. The technique of introducing dislocations into silver halide grains under careful control is disclosed in JP-A-63-220238. According to this gazette, the dislocation can be introduced by forming a particular phase having a high iodide content inside the tabular silver halide grains having an average grain diameter/grain thickness ratio of at least 2 and covering the outside with a phase lower in iodide content than the aforesaid phase having a high iodide content. The introduction of such a dislocation can produce various effects, including an increase in photographic speed, improvement in keeping quality, a rise in latent image stability and reduction in pressure mark. According to the invention of the reference cited above, the dislocations are introduced mainly in the edge part of tabular grains. On the other hand, the tabular grains having dislocations introduced in the core part are disclosed in U.S. Pat. No. 5,238,796. Further, the grains having a regular crystal form and dislocations on the inside are disclosed in JP-A-4-348337. And this gazette discloses that the dislocations can be introduced by forming epitaxides of silver chloride or silver chlorobromide on the grains having a regular crystal form and subjecting the epitaxies to physical ripening and/or halogen conversion. Into the silver halide grains according to the invention, dislocations can be introduced by the method of constituting a phase having a high iodide content as well as the method of forming epitaxies of silver chlorobromide on the grains. By the introduction of dislocations in such a way, the effects of increasing the photographic speed and decreasing the pressure mark are produced. The dislocation lines in the silver halide grains can be observed by a direct method using a transmission type electron microscope at a low temperature as described in J. F. Hamilton, "*Photo. Sci. Eng.*", 1967, 11, 57, and T. Shiozawa, "*J. Soc. Photo. Sci. JAPAN*", 1972, 35, 213. In some detail, silver halide grains which have been withdrawn from the emulsion in such a manner that it is not under a pressure high enough to produce dislocation lines are placed on a mesh for electron microscopy where the specimen is then observed by a transmission method while being cooled so as to prevent itself from being damaged (print out) due to electron beam. The greater the thickness of the grains is, the more difficultly electron beam can be transmitted thereby. Therefore, a high voltage type (200 kV or higher per 0.25 $\mu$m thickness) electron microscope is preferably used to make a sharper observation. From the photograph of grains thus obtained can be determined the position and number of dislocation lines on each of grains as viewed perpendicularly to the major plane. The present invention can achieve its effects when at least 50% of the total silver halide grains are grains in which at least 10 dislocation lines per grain are present.

The preparation of silver halide emulsions has no particular restrictions on additives used from the grain formation step till the coating step. For the purpose of promoting the crystal growth in the crystal-forming step or achieving effective chemical sensitization at the time of grain formation and/or chemical sensitization, silver halide solvents can be utilized. As preferred silver halide solvents, it is possible to use water-soluble thiocyanates, ammonia, thioethers and thioureas. More specifically, the thiocyanates disclosed in U.S. Pat. Nos. 2,222,264, 2,448,534 and 3,320,069, ammonia, the thioether compounds disclosed in U.S. Pat. Nos. 3,271,157, 3,574,628, 3,704,130, 4,297,439 and 4,276,347, the thion compounds disclosed in JP-A-53-144319, JP-A-53-82408 and JP-A-55-77737, the amine compounds disclosed in JP-A-54-100717, the thiourea derivatives disclosed in JP-A-55-2982, the imidazoles disclosed in JP-A-54-100717 and the substituted mercaptotetrazoles disclosed in JP-A-57-202531 can be recited as usable silver halide solvents.

The silver halide emulsions used in the invention has no particular restrictions on their preparation methods. In general, aqueous silver salt and halide solutions are added to a reaction solution containing an aqueous gelatin solution with efficient agitation. The methods usable therein are described in, e.g., P. Glafkides, *Chimie et Physique Photographique*, Paul Montel (1967), G. F. Duffin, *Photographic Emulsion Chemistry*, The Focal Press (1966), V. L. Zelikman, et al., *Making and Coating Photographic Emulsion*, The Focal Press (1964). More specifically, the emulsions may be prepared by any of acid, neutral and ammoniacal methods, and the methods employed for reacting a water-soluble silver salt with a water-soluble halide may be any of a single jet method, a double jet method and a combination thereof. Further, the so-called controlled double jet method, wherein the pAg of the liquid phase in which silver halide grains to be precipitated is maintained constant, may be employed. In addition, it is also desirable that the emulsion grains be made to grow at the highest speed under the critical supersaturation limit by the use of the method of altering the addition speeds of aqueous silver nitrate and alkali halide solutions in proportion to the grain growth speed (as disclosed in U.K. Patent 1,535,016, JP-B-48-36890 and JP-B-52-16364) or the method of changing the concentrations of aqueous solutions (as disclosed in U.S. Pat. No. 4,242,445 and JP-A-55-158124). These methods can be employed to advantage, because they cause no renucleation and ensure uniform growth of silver halide grains.

In another method which can be used to advantage, previously prepared fine grains are added to a reaction vessel instead of adding a silver salt solution and a halide solution to a reaction vessel, thereby causing nucleation and/or grain growth to prepare silver halide grains. The techniques concerning this method are disclosed in JP-A-1-183644, JP-A-1-183645, JP-A-2-44335, JP-A-2-43534, JP-A-2-43535 and U.S. Pat. No. 4,879,208. According to this method, the halogen ion distribution inside the emulsion grains can be uniform throughout to provide desirable photographic characteristics. On the other hand, emulsion grains having various structures can be used in the invention, too. For instance, the grains constituted of the inner part (core part) and the outside thereof (shell part), or the grains having the so-called core/shell double-layered structure, the grains having a triple-layered structure (disclosed in JP-A-60-222844) and the grains having a multi-layer structure can be used. In a case where the emulsion grains are formed so as to have an internal structure, the internal structure may be not only the wrapped-in structure as described above but also the so-called joined structure as disclosed in JP-A-58-108526, JP-A-59-16254, JP-A-59-133540, JP-A-B-24772 and EP-A2-0199290. Specifically, each host crystal joins crystallites differing therefrom in composition at its edge(s), corner(s) or face(s), and the crystallites are made to grow on the joined sites(s) to form a crystal having a joined structure. In forming such crystals joined, the host crystal may have a uniform halide composition or a core/shell structure. In the case of forming a joined structure, though crystals of silver halide can be joined together as a matter of course, another silver salt compound having a structure other than the rock salt structure, such as silver thiocyanate or silver carbonate, may also be used so long as it can attain an epitaxic growth on silver halide crystals.

In the case of silver iodobromide grains having those structures, e.g., a core/shell structure, the iodide content may be high in the core part and low in the shell part, or vice versa. As the silver iodobromide grains having a joined structure, the iodide content may be high in the host crystal and relatively low in the crystal joined to the host crystal, or vice versa. When the grains have an internal structure as mentioned above, the boundary between the parts differing in halide composition may have a clear interface, or may be rendered obscure by forming mixed crystals depending on the difference in halide composition. Also, a continuous change in structure may occur in the boundary region. Further, the silver halide emulsions used in the invention may undergo the treatment for rounding the emulsion grains (as disclosed in EP-B1-0096727 or EP-B1-0064412) or modifying the grain surface (as disclosed in German Patent 2306447 C2 or JP-A-60-221320). Although the invention prefers surface latent image-type silver halide emulsions, it is also possible to use an internal latent image type silver halide emulsion, provided that the developer or developing condition is chosen properly, as disclosed in JP-A-59-133542. In addition, a shallow internal latent image-type emulsion which is covered with a thin shell can be employed depending on the intended use.

In general, the silver halide emulsions are spectrally sensitized. Spectral sensitizing dyes usually employed therefor are methine dyes, including cyanide dyes, merocyanine dyes, composite cyanine dyes, composite merocyanine dyes, holopolar cyanine dyes, hemicyanine dyes, styryl dyes, and hemioxonol dyes. Any rings usually present in cyanine dyes can be the basic heterocyclic rings of these dyes. Suitable examples of a basic heterocyclic ring include pyrroline, oxazoline, thiazoline, pyrrole, oxazole, thiazole, selenazole, imidazole, tetrazole and pyridine rings. In addition, rings formed by condensing together a hetero ring as described above and an alicyclic hydrocarbon ring, and rings formed by condensing together a hetero ring as described above and an aromatic hydrocarbon ring can also be utilized. Examples of such a condensed ring include indolenine, benzindolenine, indole, benzoxazole, naphthoxazole, benzothiazole, naphthothiazole, benzoselenazole, benzimidazole and quinoline rings. Each of these rings may have a substituent group on any of carbon atoms as the constituent atoms thereof. The merocyanine and composite merocyanine dyes can contain 5- or 6-membered heterocyclic rings, such as pyrazoline-5-one, thiohydantoin, 2-thioxazolidine-2,4-dione, thiazolidine-2,4-dione, rhodanine and thiobarbituric acid rings, as ketomethylene structure-containing rings.

The suitable amount of sensitizing dyes added is from 0.001 to 100 millimols, preferably from 0.01 to 10 millimols, per mol of silver halide. It is desirable for the sensitizing dyes to be added during chemical sensitization or before chemical sensitization (e.g., at the time of grain formation or physical ripening).

In the present invention, the sensitivity to light of the wavelengths at which the chemically sensitized silver halide grains show their intrinsic absorption (namely the intrinsic sensitivity) is improved. More specifically, a decrease in the sensitivity to light of wavelengths longer than about 450 mn which is attributable to the adsorption of spectral sensitizing dyes to the surface of silver halide grains, namely the intrinsic desensitization due to sensitizing dyes, can be lessened by the doping with any of the complexes of the present invention. In other words, besides the effect of increasing the intrinsic sensitivity of silver halide, the present invention has a beneficial effect upon the prevention of the intrinsic desensitization due to sensitizing dyes.

To silver halide emulsions may be added dyes which, although they themselves do not spectrally sensitize silver halide emulsions, or materials which, although they do not absorb light in the visible region, can exhibit supersensitizing effect in combination with a certain sensitizing dye. Examples of such dyes or materials include aminostilbene compounds substituted by nitrogen-containing heterocyclic groups (disclosed in U.S. Pat. Nos. 2,933,390 and 3,635,721), aromatic organic acid-formaldehyde condensates (disclosed in U.S. Pat. No 3,743,510), cadmium salts and azaindene compounds. The combinations of spectral sensitizing dyes with the dyes or materials as described above are disclosed in U.S. Pat. Nos. 3,615,613, 3,615,641, 3,617,295 and 3,635,721.

In general, the silver halide emulsions are used after undergoing chemical sensitization. For chemical sensitization, chalcogen sensitization (including sulfur sensitization, selenium sensitization, and tellurium sensitization), noble metal sensitization (including gold sensitization) and reduction sensitization can be employed individually or as a combination of at least two thereof. In the present invention, chemical sensitization involving sulfur sensitization and gold-sulfur sensitization in combination is preferably used. Selenium sensitization or tellurium sensitization also is preferably used. In sulfur sensitization, labile sulfur compounds are used as sensitizer. Examples of such labile sulfur compounds are described in P. Glafkides, *Chimie et Physique Photographique,* 5th ed., Paul Montel (1087), *Research Disclosure* vol. 307, No. 307105, T. H. James, *The Theory of The Photographic Process,* 4th ed., Macmillan (1977) and H. Frieser, *Die Grülagender Photographischen Prozess mit Silver-Halogeniden,* Akademische Verlags-geselbshaft (1968). Examples of suitable sulfur sensitizers which can be used include thiosulfates (such as sodium thiosulfate and p-toluenethiosulfate), thioureas (such as diphenylthiourea, triethylthiourea, N-ethyl-N'-(4-methyl-2-thiazolyl)thiourea and carboxymethyltrimethylthio-urea), thioamides (such as thioacetamide and N-phenylthioacetamide), rhodanines (such as rhodanine, N-ethylrhodanine, 5-benzylidenerhodanine, 5-benzylidene-N-ethylrhodanine and diethylrhodanine), phosphine sulfides (such as trimethylphosphine sulfide), thiohydrantoins, 4-oxo-oxazolidine-2-thiones, dipolysulfides (such as dimorphiline disulfide, cystine and hexathiocane-thione), mercapto compounds (such as cysteine), polythionates and elemental sulfur. Also, active gelatins can be utilized as sulfur sensitizer.

In selenium sensitization, labile selenium compounds are used as sensitizer. The labile selenium compounds for such a purpose are disclosed in JP-B-43-13489, JP-B-44-15748, JP-A-4-25832, JP-A-4-109240, JP-A-4-271341 and JP-A-5-40324. Examples of suitable selenium sensitizer which can be used include colloidal metallic selenium, selenoureas (such as N,N-dimethylselenourea, trifluoromethylcarbonyl-trimethyl-selenourea and acetyl-trimethylselenourea), selenoamides (such as selenoacetamide and N,N-trimethylselenourea), selenoamides (such as selenoacetamide and N,N-dimethylphenylselenamide), phosphine selenides (such as triphenylphosphine selenide and pentafluorophenyl-triphenylphosphine selenide), selenophosphates (such as tri-p-tolylsenenophosphate and tri-n-butylselenophosphate), selenoketones (such as selenobenzophenone), isoselenocuanates, selenocarboxylic acids, selenoesters and diacylselenides. In addition, moderately stable selenium compounds (as disclosed in JP-B-46-4553 and JP-B-52-34492), including selenious acid, potassium selenocyanate, selenazoles and selenides, can also be utilized as selenium sensitizers.

In tellurium sensitization, labile tellurium compounds are used as sensitizer. The labile tellurium compounds for such a purpose are disclosed in Canadian Patent 800,958, U.K. Patents 1,295,462 and 1,396,696, JP-A-4-204640, JP-A-4-271341, JP-A-4-333043 and JP-A-4-303157. Examples of suitable tellurium sensitizers which can be used include telluroureas (such as tetramethyl-tellurourea, N,N'-dimethylethylenetellurourea and N,N'-diphenylethylenetellurourea), phosphine tellurides (such as butyldiisopropylphosphine telluride, tributyl-phosphine telluride, tributoxyphosphine telluride and ethoxydiphenylphosphine telluride), diacyl (di) (tellurides (such as bis (diphenylcarbamoyl) ditelluride, bis(N-phenyl-N-methylcarbamoyl) ditelluride and bis(ethoxycarbonyl) telluride), isotellurocyanates (such as allyl-isotellurocyanate), telluroketones (such as telluroacetone and telluroacetophenone), telluroamides (such as telluroacetamide and N,N-dimethyltellurobenzamide), tellurohydrazides (such as N,N',N'-trimethyl-tellurobenzohydrazide), telluroesters (such as t-butyl-t-hexytelluroester), colloidal tellurium, (di)tellurides and other tellurium compounds (such as potassium telluride and sodium telluropentathionate).

In noble metal sensitization, the salts of noble metals, such as gold, platinum, palladium and iridium, are used as sensitizer. The noble metal salts for such a purpose are described in, e.g., P. Glafkides, *Chimie et Physique Photographique,* 5th ed., Paul Montel (1087), and *Research Disclosure* vol. 307, No. 307105. In particular, gold sensitization is preferred. Examples of gold compounds suitable for gold sensitization include chloroauric acid, potassium chloroaurate, potassium aurithiocyanate, gold sulfide and gold selenide. In addition, the gold compounds disclosed in U.S. Pat. Nos. 2,642,361, 5,049,484 and 5,049,485 can also be used as gold sensitizer.

In reduction sensitization, reducing compounds are used as sensitizer. The reducing compounds for such a purpose are described in, e.g., P. Glafkides, *Chimie et Physique Photographique,* 5th ed., Paul Montel (1087), and *Research Disclosure* vol. 307, No. 307105. Examples of suitable reduction sensitizers which can be used include aminoiminomethanesulfinic acid (thiourea dioxide), borane compounds (such as dimethylamine borane), hydrazine compounds (such as hydrazine and p-tolylhydrazine), polyamine compounds (such as diethylenetriamine and triethylenetriamine), stannous chloride, silane compounds, reductones (such as ascorbic acid), sulfites, aldehyde compound and hydrogen. In addition, reduction sensitization can be carried out in an atmosphere of high pH or excess silver ions (the so-called silver ripening).

Two or more kinds of chemical sensitization may be carried out in combination. In particular, the combination of chalcogen sensitization and gold sensitization is preferred over the others. Further, it is desirable that the reduction sensitization be carried out in the step of forming silver halide grains. The amount of each sensitizer used is generally determined depending on what type of silver halide grains are sensitized and what condition is adopted for the chemical sensitization. Specifically, the amount of a chalcogen sensitizer used is generally from $10^{-8}$ to $10^{-2}$ mols, preferably from $10^{-7}$ to $5\times10^{-3}$ mols, per mol of silver halide. The amount of a noble metal sensitizer used is preferably from $10^{-7}$ to $10^{-2}$ mols per mol of silver halide. As to the conditions for chemical sensitization, there are no particular restrictions. However, it is desirable that the pAg be from 6 to 11, preferably from 7 to 10, the pH be from 4 to 10 and the temperature be from 40° C. to 95° C., preferably from 45° C. to 85° C.

The silver halide emulsions can contain a wide variety of compounds for purpose of preventing fogging or stabilizing photographic properties during production, storage or photographic processing of the photographic material. Examples of compounds usable for the foregoing purposes include azoles (such as benzothiazolium salts, nitroindazoles, triazoles, benzotriazoles, imidazoles and benzimidazoles (especially those substituted with nitro groups or halogen atoms)), heterocyclic mercapto compounds (such as mercaptothiazoles, mercaptobenzothiazoles, mercaptobenzimidazoles, mercaptothiadiazoles, mercaptotetrazoles (especially 1-phenyl-5-mercaptotetrazole) and mercaptopyrimidines), the above-recited heterocyclic mercapto compounds further containing a water-soluble group, such as a carboxyl or sulfo group, thioketo compounds (such as oxazolinethione), azaindene compounds (such as tetraazaindenes (especially 1,2,3a,7-tetraazaindenes substituted with a hydroxyl group at the 4-position)), benzenethiosulfonic acids and benzenesulfinic acid. In general, these compounds are known as antifoggants or stabilizers.

The appropriate time for addition of such an antifoggant or stabilizer is generally after chemical sensitization. However, the time for addition may be chosen from any stages during or before chemical sensitization. Specifically, the antifoggants or stabilizers may be added during the addition of a silver salt solution in the process of forming silver halide emulsion grains, or during the period from the conclusion of addition of a silver salt solution to the beginning of chemical sensitization, or during chemical sensitization (preferably during the first half of chemical sensitization, more preferably during the period from the beginning of chemical sensitization to the time corresponding to one fifth of chemical sensitization time).

The present silver halide photographic materials have no particular restrictions as to their layer structures. When they are color photographic materials, however, they have a multi-layer structure for recording blue light, green light and red light separately. Further, each silver halide emulsion layer may be constituted of two layers, a high speed layer and a low speed layer. Examples of a practical layer structure (1) to (6) are given below:

(1) BH/BL/GH/GL/RH/RL/S;

(2) BH/BM/BL/GH/GM/GL/RH/RM/RL/S;

(3) BH/BL/GH/RH/GL/RL/S;

(4) BH/GH/RH/BL/GL/RL/3;

(5) BH/BL/CL/GH/GL/RH/RL/S; and (6) BH/BL/GH/GL/CL/RH/RL/S

Therein, B stands for a blue-sensitive layer, G for a green-sensitive layer, R for a red-sensitive layer, H for a highest speed layer, M for a medium speed layer, L for a low speed layer, S for a support, and CL for an interlayer effect-providing layer. Light-sensitive layers, such as a protective layer, a filter layer, an interlayer, an anti-halation layer and a subbing layer, are omitted from the foregoing representation of layer structures. Further, the arranging order or high-speed and low-speed layers having the same color sensitivity may be reversed. The layer structure (3) is described in U.S. Pat. No. 4,184,876. The layer structure (4) is described in *Research Disclosure,* vol. 225, No. 22534, JP-A-59-177551 and JP-A-59-177552. The layer structures (5) and (6) are described in JP-A-61-34541. Of these layer structures, the layer structures (1), (2) and (4) are preferred over the others. Besides color photographic materials, the silver halide photographic materials of the invention can be applied to X-ray photographic materials, sensitive materials for black and white photography, sensitive materials for platemaking, and photographic printing paper.

For various additives usable in the silver halide emulsions (e.g., binders, chemical sensitizers, spectral sensitizers, stabilizers, gelatin, hardeners, surfactants, antistatic agents, polymer latexes, matting agents, color couplers, ultraviolet absorbents, discoloration inhibitors, dyes), supports usable in the photographic materials and processing methods applicable to the photographic materials (e.g., coating methods, exposure methods, development-processing methods), the descriptions in Research Disclosure, vol. 176, No. 17643 (abbreviated as "RD-17643"), vol. 187, No. 18716 (abbreviated as "RD-18716") and vol. 225, No. 22534 (abbreviated as "RD-22534") can be reffered to. The locations where the additives are described in each of those references are listed below.

| Kinds of Additives | RD-17643 | RD-18716 | RD-22534 |
|---|---|---|---|
| 1. Chemical sensitizer | p. 23 | p. 648, right column | p. 24 |
| 2. Sensitivity increasing agent | | p. 648, right column | |
| 3. Spectral sensitizer and Supersensitizer | pp. 23–24 | p. 648, right column, to p. 649, right column | pp. 24–28 |
| 4. Brightening agent | p. 24 | | |
| 5. Antifoggant and Stabilizer | pp. 24–25 | p. 649, right column | p. 24, 31 |
| 6. Light absorbent, Filter dye, UV absorbent | pp. 25–26 | p. 649, right column, to p. 650, left column | |
| 7. Stain inhibitor | p. 25, right column | p. 650, left to right column | |
| 8. Dye image stabilizer | p. 25 | p. 32 | |
| 9. Hardener | p. 26 | p. 651, left column | p. 32 |
| 10. Binder | p. 26 | p. 651, left column | p. 28 |
| 11. Plasticizer, Lubricant | p. 27 | p. 650, right column | |
| 12. Coating aid, Surfactant | pp. 26–27 | p. 650, right column | |
| 13. Antistatic agent | p. 27 | p. 650, right column | |
| 14. Color coupler | p. 25 | p. 649 | p. 31 |

As gelatin hardeners there are preferably used active halogen compounds (such as 2,4-dichloro-6-hydroxy-1,3,5-triazine and sodium salts thereof) and active vinyl compounds (such as 1,3-bisvinylsulfonyl-2-propanol, 1,2-bis(vinylsulfonylacetamide)ethane and vinyl polymer having vinylsulfonyl group in its chain) because they can rapidly harden hydrophilic colloids such as gelatin to provide stable photographic properties. Also, N-carbamoyl-pyridinium salts (such as (1-morpholinocarbonyl-3-pyridinio)

ethanesulfonate) or haloamidinium salts (such as 1-(1-chloro-1-pyridinomethylene)pyrrolidinium-2-naphthalenesulfonate) can rapidly harden hydrophilic colloids and therefore are preferred.

The color photographic materials of the present invention can be processed using the general methods described in *Research Disclosure,* vol. 176, No. 17643 and ibid, vol. 187, No. 18716. Specifically, the color photographic materials are subjected sequentially to development processing, bleach-fix processing or fixation processing, and washing or stabilization processing. In the washing step, a counter-current washing method using at least two tanks is generally adopted to effect a water saving. As a typical example of stabilization processing which can take the place of washing processing, the multistage counter-current stabilization processing as disclosed in JP-A-57-8543 can be exemplified.

EXAMPLE

The present invention will be further described hereinafter in the following examples, but the present invention should not be construed as being limited thereto.

Example 1

Preparation of Emulsion 1-1(Octahedral Silver Bromide Emulsion (1):

To 870 ml of water were added 36 g of deionized gelatin and 0.25 g of potassium bromide to prepare an aqueous gelatin solution. To the aqueous gelatin solution which had been kept at a temperature of 75° C. were then added 36 ml of a 0.088 M aqueous solution of silver nitrate (Solution 1) and 36 ml of a 0.088 M aqueous solution of potassium bromide (Solution 2) at a constant flow rate for 10 minutes by a double jet method while stirring. Subsequently, to the gelatin solution were added 176 ml of Solution 1 and 176 ml of Solution 2 in 7 minutes by a double jet method. Thereafter, to the gelatin solution were added 898 ml of a 0.82 M aqueous solution of silver nitrate (Solution 3) for 90 minutes at an accelerated flow rate, beginning with the flow rate of 0.53 ml/min, and simultaneously therewith a 0.90 M aqueous solution of potassium bromide (Solution 4) so that the pBr was maintained at 2.93. Subsequently, to the emulsion was added 90 ml of Solution 3 at a constant flow rate for 5 minutes. Simultaneously therewith, the aqueous solution of potassium bromide (Solution 5), the concentration of which was the same as that of Solution 4, was added while controlling the addition rate so that the pBr was kept at 2.93. After 5-minute lapse from the conclusion of the addition, the reaction solution was cooled to 35° C., and the soluble salts were removed by an ordinary flocculation method. The resulting solution was heated again to 40° C., and additional gelatin in an amount of 50 g was dissolved thereinto. The emulsion thus prepared was admixed with potassium bromide and 2-phenoxyethanol, and adjusted to pH 6.5. The emulsion grains formed in the foregoing manner were monodisperse silver bromide octahedron having an edge length of 0.5 $\mu$m.

Preparation of Comparative Emulsions 1-2 to 1-6 (Octahedral silver bromide Emulsions doped with $[Fe(CN)_6]^{4-}$, $[RuCl_4(bpy)]^-$, $[Ru(CN)_5(MTP)]^{3-}$, $[Ru(CN)_5(SHBzIm)]^{3-}$ and $[Ru(thia)_6]^{2+}$, respectively) (Comparison)

Emulsions 1-2 to 1-6 were prepared in the same manner as Emulsion 1-1 except that $[Fe(CN)_6]^{4-}$, $[RuCl_4(bpy)]^-$ (in which bpy represents 2,2'-bipyridine), $[Ru(CN)_5(MTP)]^{3-}$ (in which MTP represents 5-methyl-s-triazolo(1.5-A)-pyrimidine-7-ol), $[Ru(CN)_5(SHBzIm)]^{3-}$ (in which SHBzIm represents 2-mercaptobenzimidazole) and $[Ru(thia)_6]^{2+}$ (in which thia represents thiazole) were added, respectively, to Solution 5 in an amount of $1\times10^{-5}$ mols per mol of silver added at this stage. (Since the amount of silver added at this stage corresponds to 10% based on the total amount of silver, these dopants are added to the grains at the portion of from 90% to 100% by volume (surface layer to a thickness of 10% from the surface of grain))

Preparation of Emulsions 1-7 to 1-17 (Octahedral silver bromide emulsions): (Invention)

Emulsions 1–6 to 1–17 were prepared in the same manner as Emulsion 1–1 except that $[Fe(bpy)_3]^{2+}$, $[Ru(phen)_3]^{2+}$ (in which phen represents 1,10-phenanthroline), $[Ru(bpy)_2Cl_2]^0$, $[Fe(bpy)_3]^{2+}$, $[Fe(phen)_2]^{2+}$, $[Co(bpy)_3]^{2+}$, $[Ru(bpy)_2(phen)]^{2+}$, $[Ru(trpy)_3]^{2+}$ (in which trpy represents 2,2':6',2"-terpyridine), $[Ru(trpy)(bpy)Cl]^+$, $[Ru(trpy)(bpy)(py)]^{2-}$ (in which py represents pyridine) and $[Ru(py)_6]^{2+}$ were added, respectively, to Solution 5 in an amount of $1\times10^{-5}$ mols per mol of silver added at this stage.

To the foregoing silver bromide emulsions 1-1 to 1-7 were each added sodium thiosulfate in an amount of $8.0\times10^{-6}$ mols per mol of silver, chloroauric acid in an amount of $9.6\times10^{-6}$ mols per mol of silver and potassium thiocyanate in an amount of $3.4\times10^{-4}$ mols per mol of silver. These emulsions were each subjected to optimum chemical sensitization at a temperature of 60° C. To each of these emulsions which had been chemically sensitized was then added the following sensitizing dye (1) in an amount of $4.9\times10^{-4}$ mols/mol-Ag so that it was subjected to spectral sensitization. To each of these emulsions were then added gelatin and sodium dodecylbenzenesulfonate. These emulsions were each then applied to a triacetyl cellulose film support having a subbing layer together with a protective layer containing gelatin, polymethyl-methacrylate particles and sodium salt of 2,4-dichloro-6-hydroxy-s-triazine using an extrusion method at a silver coverage of 2 g/m$^2$. Thus, Coated Samples 1-1 to 1-7 were prepared.

Sensitizing Dye (1)

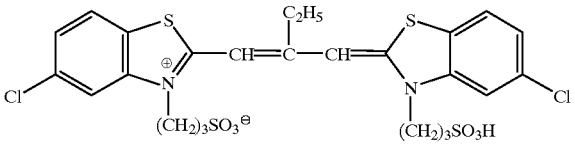

These samples were each subjected to exposure for sensitometry (1 second and $10^{-3}$ seconds) through an optical wedge, and then developed for 10 minutes at 20° C. with Developer 1 prepared according to the formula described below. Thereafter, these samples each sequentially underwent stop, fixation, washing and drying operations, according to the ordinary method, and then measured for optical densities. The fog was determined as the minimum density of each sample, and the sensitivity was represented by the logarithm of an exposure amount required for providing the optical density of fog+0.1. The sensitivities of these samples are shown as relative values in Table 1, with the dopant-free sample being taken as 100. Table 1 shows the relative sensitivities of Coated Samples 1-1 to 1-7 determined when exposed to light of wavelengths corresponding to the absorption by the spectral sensitizing dye.

| Developer 1 | |
|---|---|
| Metol | 2.5 g |
| L-Ascorbic acid | 10.0 g |
| Nabox | 35.0 g |
| KBr | 1.0 g |
| Water to make | 1 liter |
| pH adjusted to | 9.6 |

exerts an effect of providing higher sensitivity. However, the resulting effect is about the same as the foregoing two cyano complexes but is inferior to that of the dopants of the present invention. Moreover, the emulsions doped with $[Fe(CN)_6]^{4-}$, which is most frequently used as a dopant for providing higher sensitivity, exert an effect of providing higher sensitivity. The emulsions doped with $[Ru(phen)_3]^{2+}$ exerts the same effect as above. Moreover, the emulsions doped with $[Ru(bpy)_3]^{2+}$ has a far higher sensitivity than the emulsions doped with $[Fe(CN)_6]^{4-}$ at low intensity.

TABLE 1

| Sample No. | Emulsion No. | Dopant[α] | Relative sensitivity*1 | |
|---|---|---|---|---|
| | | | 1 sec. exposure | $10^{-3}$ sec. exposure |
| 1-1(comparative) | 1-1 | Not added | 100 | 100 |
| 1-2(comparative) | 1-2 | $[Fe(CN)_6]^{4-}$ | 186 | 198 |
| 1-3(comparative) | 1-3 | $[RuCl_4(bpy)]^-$ | 102 | 101 |
| 1-4(comparative) | 1-4 | $[Ru(CN)_5(MTP)]^{3-}$ | 132 | 125 |
| 1-5(comparative) | 1-5 | $[Ru(CN)_5(SHBzIm)]^{3-}$ | 129 | 122 |
| 1-6(comparative) | 1-6 | $[Ru(thia)_6]^{2+}$ | 129 | 127 |
| 1-7(invention) | 1-7 | $[Ru(bpy)_3]^{2+}$ | 204 | 196 |
| 1-8(invention) | 1-8 | $[Ru(phen)_3]^{2+}$ | 188 | 174 |
| 1-9(invention) | 1-9 | $[Ru(bpy)_2Cl_2]^0$ | 134 | 121 |
| 1-10(invention) | 1-10 | $[Fe(bpy)_3]^{2+}$ | 152 | 141 |
| 1-11(invention) | 1-11 | $[Fe(phen)_3]^{2+}$ | 158 | 148 |
| 1-12(invention) | 1-12 | $[Co(bpy)^3]^{2+}$ | 177 | 169 |
| 1-13(invention) | 1-13 | $[Ru(bpy)^2(phen)]^{2+}$ | 174 | 170 |
| 1-14(invention) | 1-14 | $[Ru(trpy)_2]^{2+}$ | 165 | 156 |
| 1-15(invention) | 1-15 | $[Ru(trpy)(bpy)Cl]^+$ | 136 | 119 |
| 1-16(invention) | 1-16 | $[Ru(trpy)(bpy)(py)]^{2+}$ | 148 | 124 |
| 1-17(invention) | 1-17 | $[Ru(py)_6]^{2+}$ | 167 | 146 |

α: Symbols bpy, phen, trpy, py, MTP, SHBzIm and thia given to the ligands of the foregoing dopants represent 2,2'-bipyridine, 1,10-phenanthroline, 2,2': 6',2"-terpyridine, pyridine, 5-methyl-s-triazole(1,5-A)-pyridimidine-7-ol, 2-mercaptobenzimidazole and thiazole, respectively.
*1: Sensitivities are shown as relative values, with Emulsion 1-1 being taken as 100 under each condition.

Table 1 shows the photographic sensitivities of the emulsions doped with the various complexes of the present invention in the layer corresponding to from 90% to 100% of the total volume of each silver halide grain (surface layer). It can be seen in Table 1 that the emulsions comprising the dopants of the present invention have greater sensitivity that those free of dopants, demonstrating that complexes all the ligands of which have no electric charge provide higher sensitivity. In particular, the emulsions doped with $[Ru(bpy)_3]^{2+}$ or $[Ru(phen)_3]^{2+}$ have higher sensitivity. In the present invention, the preferred number of bidentate ligands is 2 or 3. This is probably because a complex having one bidentate ligand such as $[RuCl_4(bpy)]^-$ as shown in a comparative example has a central metal which can easily be trivalent and become a deep electron trap and thus cannot contribute to increase of sensitivity as a dopant. In actuality, as can be seen in Table 1, the emulsion doped with $[RuCl_4(bpy)]^-$ doesn't shown any definite desensitization but exerts little or no effect of giving higher sensitivity. It is described in JP-A-11-102042 that $[Ru(CN)_5(MTP)]^{3-}$ and $[Ru(CN)_5(SHBzIm)]^{3-}$ are effectively high sensitizing dopants. However, the sensitivity of the emulsions doped with the two cyano complexes, respectively, are drastically surpassed by that of most of the doped emulsions of the present invention. It can also be seen that in the present invention, even the emulsions doped with $[Ru(bpy)_2Cl_2]^0$ or $[Ru(trpy)(bpy)Cl]^+$ surpass in sensitivity the emulsions doped with $[Ru(CN)_5(MTP)]^{3-}$ or $[Ru(CN)_5(SHBzIm)]^{3-}$ when subjected to exposure for 1 second. Further, $[Ru(thia)_6]^{2+}$, which is a compound included in the claims of JP-A-11-102042, though not being a complex described in this patent, Example 2

Preparation of Emulsion 2-1 (Octahedral silver bromide emulsion sample (2)):

Emulsion 2-1 was prepared in the same manner as Emulsion 1-1 in Example 1.

Preparation of Emulsion 2-2 (Octahedral silver bromide emulsion doped with $[Fe(CN)_6]^{4-}$): [Comparison]

Emulsions 2-2A and 2-2B were prepared in the same manner as Emulsion 1-1 in Example 1 except that $[Fe(CN)_6]^{4-}$ was added to Solution 5 in an amount of $1\times10^{-4}$ mol and $5\times10^{-4}$ mol, respectively, per mol of silver added at the addition stage of this solution.

Preparation of Emulsion 2-3 (Octahedral silver bromide emulsion doped with $[Ru(bpy)_3]^{2+}$ in the surface layer of grain): [Invention]

Emulsions 2-3A and 2-3B were prepared in the same manner as Emulsion 1-1 in Example 1 except that $[Ru(bpy)_3]^{2+}$ according to the present invention was added to Solution 5 in an amount of $2.5\times10^{-4}$ mol and $4\times10^{-4}$ mol, respectively, per mol of silver added at the addition stage of this solution.

Preparation of Emulsion 2-4 (Octahedral silver bromide emulsion doped uniformly with $[Ru(bpy)_3]^{2+}$ according to the present invention inside the grain: [Invention]

Emulsions 2-4A and 2-4B were prepared in the same manner as Emulsion 1-1 in Example 1 except that $[Ru(bpy)_3]^{2+}$ was added to Solution 4 and Solution 5 in an amount of $5\times10^{-4}$ mol and $2.5\times10^{-4}$ mol, respectively, per mol of silver added at the addition stage of these solutions.

Preparation of Emulsion 2-5 (Octahedral silver bromide emulsion doped uniformly with $[Ru(bpy)_3]^{2+}$ according to the present invention inside the grain): [Invention]

Emulsions 2-5A and 2-5B were prepared in the same manner as Emulsion 1-1 in Example 1 except that $[Ru(bpy)_3]^{2+}$ was added to Solution 4 in an amount of $5\times10^{-4}$ mol and $1\times10^{-4}$ mol, respectively, per mol of silver added at the addition stage of this solutions.

The foregoing silver bromide emulsions 2-1 and 2-2A to 2-5A were each subjected to optimal chemical sensitization in the same manner as in Example 1. These silver bromide emulsions were each then applied to a support in the same manner as in Example 1 to obtain Coated Samples 2-1a to 2-5B. On the other hand, Emulsions 2-1 and 2-2B to 2-5a were each subjected to optimal chemical sensitization in the same manner as mentioned above, subjected to spectral sensitization with the sensitizing dye (1) of Example 1 in an amount of $4.9\times10^{-4}$ mols/mol-Ag, and then applied to a support in the same manner as Coated Samples 2-1a to 2-5a to obtain Coated Samples 2-1b to 2-5b.

These samples were each subjected to exposure for sensitometry (1 second and $10^{-3}$ seconds) through an optical wedge, and then developed for 10 minutes at 20° C. with Developer 1 described in Example 1. Thereafter, these samples each sequentially underwent stop, fixation, washing and drying operations, according to the ordinary method, and then measured for optical densities. The fog was determined as the minimum density of each sample, and the sensitivity was represented by the logarithm of an exposure amount required for providing the optical density of fog+0.1. The sensitivities of these samples are shown as relative values in Table 1, with the dopant-free sample being taken as 100. Table 2 shows the relative sensitivities of Coated Samples 2-1a to 2-5a (samples free of spectral sensitizing dye) which were determined by exposure to light of wavelengths at which the silver halide therein showed the intrinsic absorption and the relative sensitivities of Coated Samples 2-1b to 2-5b (samples comprising spectral sensitizing dye incorporated therein) which were determined by exposure to light of wavelengths corresponding to the absorption by the spectral sensitizing dye.

With respect to $[Ru(bpy)_3]^{2+}$, a dopant which gives the highest sensitivity in Example 1, the addition site and added amount of the dopant were studied. Table 2 shows the relative sensitivity of the emulsions, including those comprising $[Fe(CN)_6]^{4-}$, at the added amount by which the highest sensitivity can be obtained at the various doping sites, with the added amount of the various dopants being varied from $1\times10^{-6}$ mol/mol-Ag to $5\times10^{-4}$ mol/mol-Ag (The added amount of dopant represents the amount of complex added per mol of silver over the total amount of silver during the preparation of the emulsion). When no sensitizing dye was added, the emulsions doped uniformly with $[Ru(bpy)_3]^{2+}$ in the interior of the grain exhibit the highest sensitivity, which surpasses that of the emulsions doped with $[Fe(CN)_6]^{4-}$. This effect can be exerted more strongly when the emulsions are exposed for $10^{-3}$ seconds. On the other hand, all the emulsions comprising the sensitizing dye incorporated therein exhibit a remarkably raised sensitivity (when exposed to light of wavelengths corresponding to the absorption of the sensitizing dye). In particular, the emulsions doped uniformly with $[Ru(bpy)_3]^{2+}$ in the interior of the grain and the emulsions doped with $[Ru(bpy)_3]^{2+}$ only in the interior of the grain exhibit a remarkably raised sensitivity. In particular, the former emulsions doped uniformly with $[Ru(bpy)_3]^{2+}$ in the interior of the grain have a remarkably raised sensitivity. These emulsions exhibit a sensitivity drastically surpassing that of the high speed emulsions doped with $[Fe(CN)_6]^{4-}$ regardless of whether they are exposed for 1 second or $10^{-3}$ seconds.

Example 3

Preparation of Emulsion 3 (Octahedral silver bromide emulsion doped uniformly with $[Ru(bpy)_3]^{2-}$ according to the present invention]: [invention]

Emulsion 2-4A obtained in Example 2 was subjected to optimal chemical sensitization, subjected to spectral sensitization, and then used as emulsion for the 3rd layer of Sample 201 in Example 2 of JP-A-9-146237. The sample thus obtained was processed in the same manner as in the examples of the above cited patent. Good results were obtained.

TABLE 2

| Sample No.*1 | Emulsion No. | Dopant (dope position; added amount)[a] | Relative sensitivity*2 1 sec. exposure | Relative sensitivity*2 $10^{-3}$ sec. exposure |
|---|---|---|---|---|
| 2-1a(comparative) | 2-1 | Not added | 100 | 100 |
| 2-2a(comparative) | 2-2A | $[Fe(CN)_6]^{4-}$(surface; $1\times10^{-5}$ mol/mol-Ag) | 130 | 132 |
| 2-3a(invention) | 2-3A | $[Ru(bpy)_3]^{2+}$(surface; $2.5\times10^{-5}$ mol/mol-Ag) | 126 | 120 |
| 2-4a(invention) | 2-4A | $[Ru(bpy)_3]^{2+}$(uniform; $5\times10^{-4}$ mol/mol-Ag) | 161 | 214 |
| 2-5a(invention) | 2-5A | $[Ru(bpy)_3]^{2+}$(internal; $4.5\times10^{-5}$ mol/mol-Ag) | 125 | 128 |
| 2-1b(comparative) | 2-1 | Not added | 100 | 100 |
| 2-2b(comparative) | 2-2B | $[Fe(CN)_6]^{4-}$(surface; $5\times10^{-5}$ mol/mol-Ag) | 349 | 422 |
| 2-3b(invention) | 2-3B | $[Ru(bpy)_3]^{2+}$(surface; $4\times10^{-5}$ mol/mol-Ag) | 204 | 186 |
| 2-4b(invention) | 2-4B | $[Ru(bpy)_3]^{2+}$(uniform; $2.5\times10^{-4}$ mol/mol-Ag) | 638 | 492 |
| 2-5b(comparative) | 2-5B | $[Ru(bpy)_3]^{2+}$(internal; $9\times10^{-5}$ mol/mol-Ag) | 575 | 409 |

[a]: In the foregoing table, bpy represents 2,2'-bipyridine. Referring to the dope position in each emulsion, "surface" represents the portion of 10% from the surface in the surface layer corresponding to 90% to 100% of the total volume of the grain, "uniform" represents uniform distribution in the interior of the grain, and "internal" represents the internal portion of from 0 to 90% of the total volume of the grain except the surface layer. The added amount represents the amount of complex added per mol of silver over the total amount of silver during the preparation of the emulsion.

*1: Samples having "a" as the suffix of their sample Nos. are sensitizing dye-free samples) and those having "b" are sensitizing dye-added samples. The former samples were exposed to light of wavelengths corresponding to the intrinsic absorption of silver bromide, while the latter samples were exposed to light of wavelengths at which the sensitizing dye showed absorption.

*2: Sensitivities shown as relative values, with Emulsion 2-1 being taken as 100 under each condition.

Example 4

Preparation of Emulsion 4 (Octahedral silver bromide emulsion doped uniformly with $[Ru(bpy)_3]^{2+}$ according to the present invention]: [invention]

Emulsion 2-4A obtained in Example 2 was subjected to optimal chemical sensitization, subjected to spectral sensitization, and then used as emulsion for the 3rd layer of Sample 110 in Example 1 of JP-A-10-20462. The sample thus obtained was processed in the same manner as in the examples of the above cited patent. Good results were obtained.

As mentioned above, by doping silver halide grains with the complexes of the present invention, silver halide photographic materials having a drastically raised sensitivity and a minimized intrinsic desensitization as compared with undoped emulsions or emulsions doped with conventional dopants such as hexacyano-complex can be obtained. In particular, emulsions doped with $[Ru(bpy)_3]^{2+}$ have a remarkably raised sensitivity, making it possible to provide a remarkably high speed silver halide photographic material.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one silver halide emulsion layer, wherein there is contained a complex in which an organic compound having no electric charge which doesn't coordinate with a metal or a metal ion other than the central metals or metal ions occupies more than half of the coordination sites of the central metals or metal ions.

2. The silver halide photographic material as in claim 1, wherein the silver halide grains contained in said emulsion contain a complex in which an organic compound having no electric charge which doesn't coordinate with a metal or a metal ion other than the central metals or metal ions occupies more than half of the coordination sites of the central metals or metal ions.

3. The silver halide photographic material as in claim 2, wherein the complex is a six-coordinated complex comprising at least one organic tridentate ligand.

4. The silver halide photographic material as in claim 3, wherein the complex is represented by the following formula II:

$$[ML_{[(6-3i)\times 1/3]}L'_iX_{[(6-3i)\times 1/3]}]^{j+} \quad \text{(II)}$$

wherein M represents a metal or metal ion capable of six-coordinated structure; L represents an organic bidentate ligand coordinated to a metal or a metal ion; L' represents an organic tridentate ligand coordinated to a metal or a metal ion; X represents an arbitrary chemical species, with the proviso that a plurality of L's, (L')'s and X's, if contained in the same compound, may be the same or different compounds, respectively; i represents an integer of 1 or 2; and j represents an integer of from −4 to +5.

5. The silver halide photographic material as in claim 4, wherein M in the formula II is a metal ion selected from the group consisting of an iron ion, ruthenium ion, manganese ion, cobalt ion, rhodium ion, iridium ion, titanium ion, chromium ion, and osmium ion.

6. The silver halide photographic material as in claim 4, wherein in the formula II, M represents an iron ion or ruthenium ion, L represents 2,2-bipyridine or 1,10-phenanthroline, L' represents 2,2':6'-2"-terpyridine, i represents an integer of 1 or 2 and j represents an integer of 2.

7. The silver halide photographic material as in claim 3, wherein the tridentate ligand is 2,2':6'-2"-terpyridine as a basic structure.

8. The silver halide photographic material as in claim 2, wherein the complex is a six-coordinated complex represented by the following formula III:

$$[ML''_kX_{(6-k)}]^{l+} \quad \text{(III)}$$

wherein M represents an a metal or metal ion capable of six-coordinated structure; L" represents an organic compound which is a monodentate ligand coordinated to a metal or a metal ion; X represents an arbitrary chemical species, with the proviso that a plurality of (L")'s and X's, if contained in the same compound, may be the same or different compounds, respectively; k represents an integer of 4 to 6; and 1 represents an integer of −4 to +5.

9. The silver halide photographic material as in claim 8, wherein L" in the formula III comprises a basic structure selected from the group consisting of furan ring, thiophenine ring, 2H-pyrrole ring, pyran ring and pyridine ring as a basic structure.

10. The silver halide photographic material as in claim 8, wherein in the formula III, M represents an iron ion or ruthenium ion, L" represents pyridine, k represents an integer of 6 and 1 represents an integer of 2.

11. The silver halide photographic material as in claim 2, wherein the complex is a six-coordinated complex having two or three organic bidentate ligands represented by the following formula I:

$$[ML_nX_{(6-2n)}]^{m+} \quad \text{(I)}$$

wherein M represents a metal or metal ion capable of six-coordinated structure; L represents an organic bidentate ligand coordinated to a metal or a metal ion; X represents an arbitrary chemical species, with the proviso that a plurality of L's and X's, if contained in the same compound, may be the same or different compounds, respectively; n represents an integer of 2 or 3; and m represents an integer of from −4 to +5.

12. The silver halide photographic material as in claim 11, wherein L in the formula I comprises 2,2'-bipyridine or 1,10-phenanthroline as a basic structure.

13. The silver halide photographic material as in claim 11, wherein M in the formula I is a metal ion selected from the group consisting of a magnesium ion, calcium ion, iron ion, ruthenium ion, manganese ion, cobalt ion, rhodium ion, iridium ion, copper ion, nickel ion, palladium ion, platinum ion, zinc ion, titanium ion, chromium ion, osmium ion and cadmium ion.

14. The silver halide photographic material as in claim 11, wherein in the formula I, M represents a metal ion selected from the group consisting of an iron ion, ruthenium ion and cobalt ion, L represents 2,2-bipyridine or 1,10-phenanthroline, n represents an integer of 2 or 3 and m represents an integer of 2.

* * * * *